United States Patent [19]

Wellman

[11] 3,934,729

[45] Jan. 27, 1976

[54] TOWER CRANE

[75] Inventor: Donald E. Wellman, Komoka, Canada

[73] Assignee: General Crane Industries Limited, London, Canada

[22] Filed: Aug. 21, 1974

[21] Appl. No.: 499,417

Related U.S. Application Data

[60] Division of Ser. No. 144,199, May 17, 1971, abandoned, which is a continuation-in-part of Ser. No. 818,751, April 23, 1969, abandoned.

[30] Foreign Application Priority Data

Apr. 9, 1969 Canada ..... 48201

[52] U.S. Cl. ..... 212/46 A; 212/46 B; 254/139.1

[51] Int. Cl.[2] ..... B66C 23/62

[58] Field of Search ..... 212/35 R, 55, 46 R, 46 A, 212/46 B, 59 R, 58 R, 69, 144; 254/139.1

[56] References Cited

UNITED STATES PATENTS

| | | | |
|---|---|---|---|
| 2,985,429 | 5/1961 | Tourneau | 254/139.1 |
| 3,134,488 | 5/1964 | Brekelbaum et al. | 212/46 R |
| 3,246,769 | 4/1966 | Noll et al. | 212/59 R |

FOREIGN PATENTS OR APPLICATIONS

| | | | |
|---|---|---|---|
| 1,039,315 | 8/1966 | United Kingdom | 212/144 |
| 1,096,078 | 12/1967 | United Kingdom | 212/46 R |
| 1,113,698 | 4/1956 | France | 212/144 |
| 1,756,568 | 6/1968 | Germany | 212/46 A |

*Primary Examiner*—Robert J. Spar
*Assistant Examiner*—Lawrence J. Oresky
*Attorney, Agent, or Firm*—Brady, O'Boyle & Gates

[57] ABSTRACT

A tower pivotally connected to a base mounting on a mobile platform is movable by raising means between a vertical operating position and a substantially horizontal travel position. A turntable at the top of the tower carries a tiltable unit which includes a jib support means and a jib pivotally connected to the jib support and adapted for luffing movement by a first hydraulic cylinder means connected between the jib and jib support means. The tiltable unit is pivotally connected to the tower and a second hydraulic cylinder means is connected to pivot the tiltable unit between an operating position and a folded position. After the jib is lowered by the first hydraulic cylinder means to an angle between about 60° and 90° with the tower axis the second hydraulic cylinder means pivots the tiltable unit through an equivalent angle to fold the jib alongside the tower when the tower crane is being moved from the vertical operating position to the substantially horizontal travelling position on the mobile platform.

3 Claims, 19 Drawing Figures

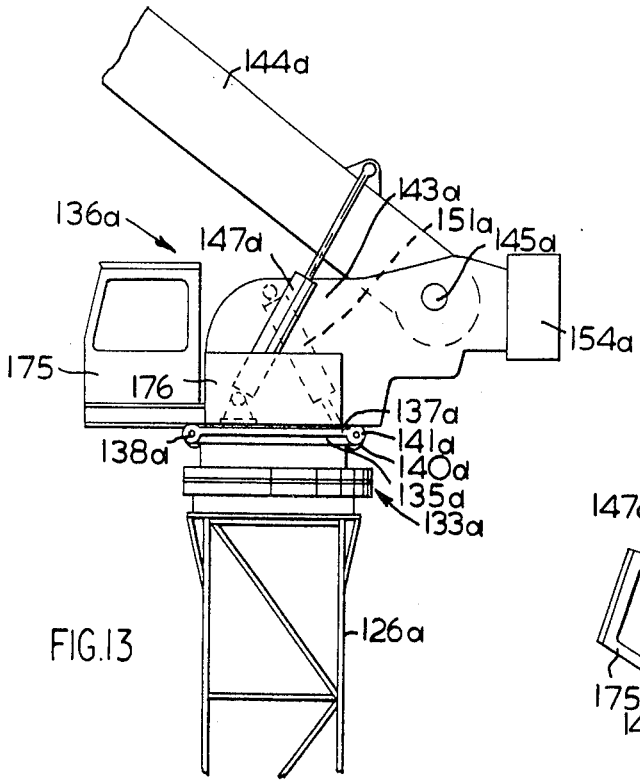
FIG.13
FIG.14
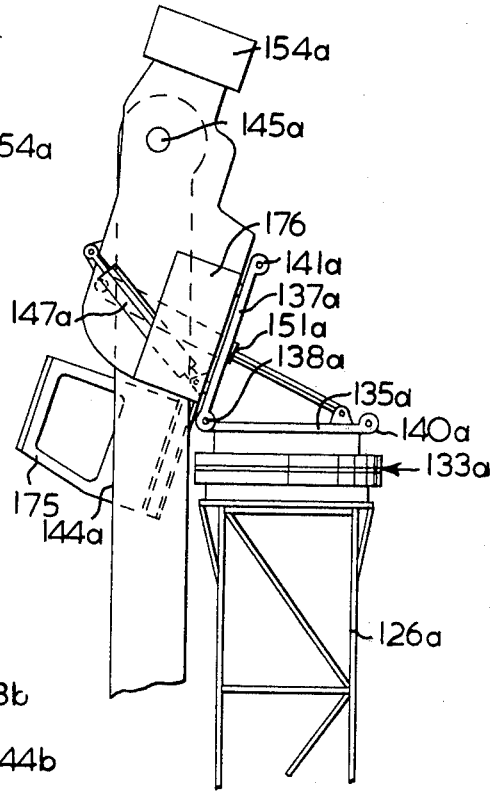
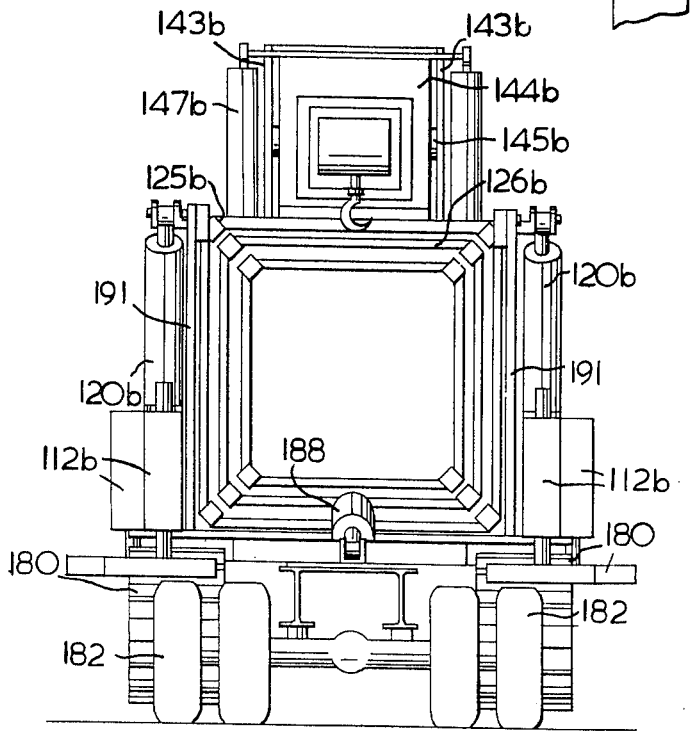
FIG.16

TOWER CRANE

This application is a division of application Ser. No. 144,199 filed May 17, 1971, now abandoned, which in turn was a continuation-in-part of application Ser. No. 818,751, filed Apr. 23, 1969, now abandoned.

The present invention relates to mobile tower cranes particularly for use on building sites. In the construction of tall buildings, there is a requirement for cranes having a tower comparable in height to the building, and having a jib mounted near the top of the tower and preferably capable of reaching out over the building.

Known mobile tower cranes are generally of the type having a mobile platform, for example the chassis of a carrier vehicle, and having a large turntable mounted directly on the mobile platform which turntable carries all the main structure of the crane. The turntable has a pivotal mounting for the base of a mast or tower allowing tilting movement of the tower from a horizontal travelling position to a vertical or nearly vertical operating position. A jib is pivotally mounted for luffing movement at the top of the tower, and cables are provided for luffing the jib, and also for staying the tower. Generally, the supporting cables are sheaved at positions spaced above and behind the jib pivot, having their lower ends attached to the turntable on the side of the tower opposite the jib. The turntable also supports a large counterweight which is on the side of the tower opposite the jib and which is associated with the lower ends of the cables. The whole crane structure rotates as a unit on the turntable.

In this type of mobile crane, the tower and the jib are stressed largely or entirely in compression and are relatively unstressed in bending, the forces which would otherwise cause bending of the tower and jib being carried by the cables. Accordingly, the tower and jib of such a crane can be relatively light and slender, as compared to a structure which could carry the same forces without resort to cables. Also, there is no need for firm fixing of the tower at its base, and in some designs the tower is merely pin-jointed at its base, and is kept upright by the cables. In conventional crane design, it seems to have been assumed that a tower and jib arrangement of this type (i.e. supported by cables) was the only suitable type for use in tall transportable tower cranes, due to its inherent lightness, and also possibly to the fact that, lacking the need for firm fixing at its base, the tower could readily be made tiltable for travelling.

These known tower cranes, although termed "mobile," in fact require considerable time and effort in erection and folding or dismantling, when moving the crane from one site to another. This is largely due to the requirement for cables for supporting the tower and jib and for luffing the jib. The many cables required have to be positioned on sheaves each time the crane is erected, and often become displaced and tangled when the crane is being transported. The fixing, sheaving, and tensioning and winching of these cables may occupy many man-hours during erection of the crane. Also, erection of such cranes always requires at least two men, one of whom is a rigger specialized in this work.

In addition, mobile cranes are known having a short telescopic tower mounted on a carrier vehicle which is fixed in the vertical position (i.e., which is non-tiltable), being merely telescopically collapsed for travelling, while remaining upright. Such cranes have a very limited height capability and are not of great use in the erection of tall buildings.

The present invention provides a crane which is much more mobile than known tower cranes of comparable height, and which has many advantages in operation, and particularly in erection, which will be explained hereinafter.

In accordance with the present invention, a mobile tower crane comprises mobile platform means (for example a truck or trailer chassis) carrying in combination a base mounting for a tower, a tower pivotally connected to the mounting for tilting movement between a vertical operating position and a substantially horizontal travelling position in which the tower is supported by the mobile platform means, and raising means interconnecting the platform means and the tower for moving the tower between the two positions. This combination of base mounting, tower and raising means is such that the tower when in the operating position and without any bracing cables provides a firm support suitable for supporting a jib structure which is rotatable relative to the tower about the tower axis and thereby in operation causes bending moments to be applied to the tower in various different directions. The jib structure carried by the tower includes a jib and jib support means, the jib support means including a turntable mounted at the top of the tower and allowing slewing of the jib support means about the tower axis, the jib being connected to the tower by pivot means including a jib pivot carried by the jib support means to allow luffing movement of the jib. Also in accordance with the invention, luffing movement of the jib is effected by hydraulic cylinder means connected between the jib and the pivot means are such as to allow the jib to be aligned with the tower for travelling. In addition, the crane may include support means and the jib, jib alignment means capable of causing angular movement of the jib independently of operation of said hydraulic cylinder means, such that combined operation of said jib alignment means and said hydraulic cylinder means can move the jib into alignment with the tower for folding the crane. Preferably, said jib alignment means is arranged to alter the relative dispositions of the tower, the jib pivot and an end of the jib luffing cylinder to cause the angular movement of the jib. The means for raising the tower, and the jib alignment means, are preferably also both hydraulic.

Preferably, the jib comprises at least two telescoping sections, and hydraulic cylinder means for telescoping the said sections. The term "jib" will be understood to mean a projecting arm of any suitable form, and includes what is known in the crane art as a boom.

An important feature of the invention is the combination of a tiltable tower which when erected does not need to be supported by cables, with a jib which is arranged to be luffed by hydraulic cylinder means, and which can also be folded alongside the tower preferably by hydraulic means operable to cause pivotal movement of the jib about said pivot means between a folded position in alignment with the tower and an operative position in which the jib forms an angle of the order of 90° with the tower axis. This arrangement allows the crane to be folded rapidly and compactly, all under hydraulic control. Also, both the jib and the tower may be made telescopic, in which case retraction of the telescopic jib and the tower would be the first operation on folding the crane. All the movements described are preferably controlled hydraulically, so that no cables are required for any of these movements. Also, the tower and its mounting arrangement, and the means for supporting and moving the jib, are such that no cables are required for staying the tower or supporting the jib, and in the preferred embodiment the only cable required for the crane is that which is attached to the crane hook. The crane may thus be erected entirely by hydraulic means (apart from certain fixing operations), under push button control.

Another advantage of the crane in accordance with the invention is that, as compared to known mobile tower cranes, a much smaller turntable can be used, since this has only to support the weight of the jib, and generally a counterweight, but does not have to support the whole weight of the tower.

It must be particularly noted that the tower of the crane in accordance with this invention is very different from the towers of known mobile cranes at least those having towers of substantial height. Instead of being a slender tower, stressed almost entirely in compression and stayed by cables, it is a rigid tower, providing a firm support for the jib structure which is rotatable about the tower axis and which therefore subjects the tower to bending stress in various directions depending on the position of the jib around the tower. To Applicant's knowledge, rigid towers which provide a firm support in this way have hitherto only been used in tower cranes which are not mobile tower cranes in the sense used herein, but wherein the base of the tower is fixed to a ground anchorage or to a building, or is carried by a rail mounted trolley. Although such cranes may be transportable in the sense of being capable of being dismantled for transportation, the dismantling and erection times of such cranes are very considerable, and these cranes cannot therefore be considered as being mobile cranes.

The jib alignment means is arranged to move between an operating position and a folded position. In the said operating position the jib luffing cylinder is capable of luffing the jib in the normal operating range between a raised position above the top of the tower and a lowered position in which the jib forms a substantial angle of the order of 90° or somewhat less with the tower axis. In the folded position of the jib alignment means the jib luffing cylinder is capable of aligning the jib with the tower axis.

The pivot means connecting the jib to the tower preferably includes a pivotal connection between the tower and a part of the jib support means, so that the jib alignment means forms a tiltable unit at the top of the tower comprising at least a part of the jib support means, tilting of this unit altering the relative disposition of the jib pivot and the jib luffing cylinder to the tower. The tiltable unit may be of two different forms. In a first embodiment the tiltable unit comprises a top section of the tower, and this top section is movable by a gear ring and pinion arrangement through an angle considerably greater than 90° and preferably about 180°, between an operating position in which the unit forms an extension of the tower and a folded position in which the unit lies alongside the tower, and thereby effectively shortens the tower for travelling. In this embodiment the jib is aligned with the tower by firstly raising the jib to a position vertically above the tower (with the tiltable unit in its operating position), and then pivoting the tiltable unit through 180° until the tiltable unit and the jib lie alongside the tower. Since the tiltable unit of this embodiment lies alongside the tower when folded, it may be of fairly substantial length, and may for example include a crane operator's cab.

In the first embodiment just described, the jib alignment means (which is the tiltable unit) is arranged to cause angular movement of the jib through 180°. In new embodiments to be described, the jib alignment means is arranged only to cause movement of the jib through a folding angle equivalent to the substantial angle (of the order of 90° or somewhat less, say between 60° and 90°) between the jib in its lowermost normal operating position and the tower. Thus where in these new embodiments, the jib alignment means is a tiltable unit, as is preferred, the tiltable unit is only required to move through this folding angle, and may be movable in this manner by a hydraulic cylinder, no gear ring being required. In these new embodiments, the relationship of the pivotal mounting for the tiltable unit to the jib pivot is such that the jib lies close to the tower when the tiltable unit is in its folded position. This would not be the case if the top section shown in the first embodiment of crane were to be rotated through an angle of much less than 180°, since the jib pivot would then be displaced well to the side of the tower. In this connection, the term "close to the tower" includes the case where parts of the jib are in contact with the tower, and aligned therrewith, and where the jib is spaced from the tower by a small amount for example in relation to the width of the tower.

An advantage of the arrangement using the tiltable unit, as compared to other possible methods of altering the relationship between the jib pivot and an end of the jib luffing cylinder, is that by the use of the tilting unit the jib pivot is brought forwards during folding with respect to the tower axis, i.e. is moved relative to the tower axis towards the side of the tower on which the jib is to be folded. Accordingly, it is possible for the jib pivot to be fairly near the axis of the jib, which would not be possible if it were required to fold the jib along the tower by rotation about a jib pivot which remained located near the tower axis. Also, in accordance with the new embodiments of my invention, with the tiltable unit in the operating position the jib pivot is behind the tower axis with respect to the outer end of the jib, and with the tiltable unit in the folded position the jib pivot is well in front of the tower axis and is preferably approximately in line with or in front of the front of the tower. The arrangement wherein, in the operating position, the jib pivot is behind the tower axis is advantageous in that most of the weight of the jib support means, in this operating position, is concentrated behind the tower axis, so partially counterbalancing the weight of the jib.

In addition, counterweight means are also preferably mounted on the rear side of the jib support means, preferably behind the jib pivot. The counterweight may be mounted on means which allow the counterweight to be extended and retracted relative to the tower axis by hydraulic means.

Another advantage of a tiltable unit is that this can be arranged so that the counterweight, and the main part of the jib support bracket, are raised relative to the tower axis when this is in the folded position, so that these parts do not interfere with folding of the tower. The tiltable unit can thus be arranged to extend over raised parts of the carrier, including for example the "goose neck" of a trailer. In one particular arrangement, the base of the tower is pivotally connected at its base to the rear end of mobile platform means in the form of a carrier such as a truck or trailer, and the tiltable unit is arranged to extend over the cab of the carrier when the crane is in the folded position.

The tower is preferably a lattice-type structure, of the type generally known in non-mobile tower cranes referred to. The tower may comprise two telescoping portions, hydraulic means being provided for causing relative movement of these portions and so altering the height of the tower. The preferred hydraulic means is a single multi-section telescoping hydraulic cylinder extending up the tower. However, for cranes of relatively low tower height, a rack and pinion mechanism for raising the tower may be preferred.

The new embodiments of crane described herein also have new folding arrangements which are advantageous from a space saving point of view. Thus, in accordance with a further aspect of the invention, a crane of the type described has a tower comprising a plurality of telescoping sections of which the lowermost section is the shortest section, and wherein the means for causing telescoping movement of said sections is such that when the tower has been laid substantially horizontal for travelling, the inner upper tower section or sections can be moved within the lower, outer tower section, so that portions of the upper section or sections project through the base of the lowermost section. This enables more space on the carrier to be utilized, as will be apparent from the following description.

A particularly advantageous arrangement from the space saving point of view is a sloping arrangement in which part of the tower projects over the top of the cab when the crane is folded. This is achieved in accordance with a further aspect of the invention by providing a crane having a tower comprising an outer member surrounding one or more tower sections slidable therein, said outer member being shorter than at least one of said tower sections, and wherein the tower is tiltably mounted on a raised mounting carried by the carrier vehicle, i.e., the mobile platform means, means being provided for causing sliding movement of said section or sections within said outer member such that when the tower is substantially horizontal a tower section or sections can be moved within said member so that its base projects well beyond said member and beyond said raised mounting, whereby in the travelling position of the tower a part of said section projects above a driver's cab forming a part of or linked to the carrier. Said outer member may be the base section of a telescopic tower. In a preferred arrangement, the tower is arranged to tilt down towards the rear end of the carrier, and in the travelling position of the tower the base portion of a section or sections of the tower projects above the driver's cab, the tower being sloped in the travelling position so that the tops of the tower sections are below the bases of the sections. The term "substantially horizontal" will be understood to include such a sloping arrangement.

A further advantageous space saving arrangement in accordance with yet another aspect of the invention includes a raised mounting on the carrier, said mounting being in the form of a bracket including two spaced apart plates, capable of accommodating between them part of the lower section of the tower, said bracket carrying a raised pivot for the tower which pivot is on the side of the bracket remote from the side on which the main part at least of the tower (and including the lowermost section of the tower) lies when in the travelling position. Accordingly, the height of the tower when raised includes the height of the bracket, up to the tower pivot.

The towers of my latest designs of crane include three or more tower sections. In order to achieve good rigidity with towers having or more tower sections, it is preferable for the tower sections to be provided with clamping means, such as hydraulically actuated plates mounted on one tower section and which clamp and firmly hold parts of an adjacent tower section, when the tower has been erected.

In order to increase the lifting capacity of my patented cranes, the carrier may be provided with areas near to the base mounting of the tower which may be suitably reinforced and which are capable of receiving counterweights for stabilizing the crane when erected.

In accordance with yet another aspect of this invention, a crane is mounted on mobile platform means provided with both crawler tracks and road wheels, and means are provided for causing relative vertical movement between the crawler tracks and the road wheels so that these can be selectively placed in contact with the ground or road. In a preferred arrangement, the rear chassis portion of the carrier (e.g., a semi-trailer) is pivotally connected to the main part of the carrier chassis for pivotal movement in the vertical plane. The main part of the carrier chassis has crawler tracks near to its rear end, and the pivotal portion has road wheels, and hydraulic means are provided for pivotally moving the pivotal portion from a raised position in which the road wheels are raised clear of a surface engaged by the crawler tracks, to a lowered position in which the road wheels contact the ground, movement of the pivotal portion to this lowered position also causing the tracks to be raised from the surface contacted by the road wheels.

Preferred embodiments in accordance with the invention will now be described by way of example with reference to the accompanying drawings, in which.

Figure 5:
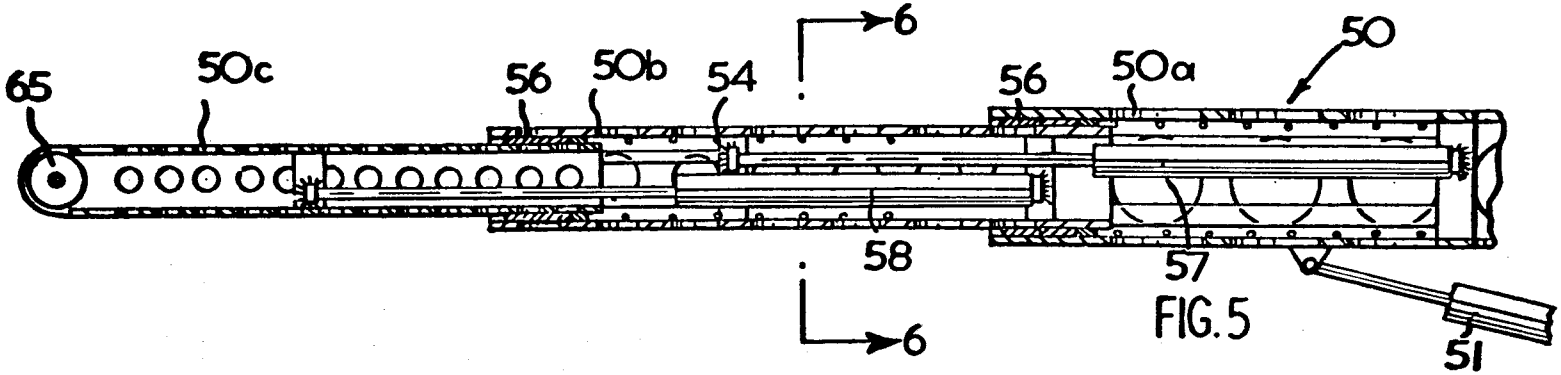
FIGS. 5 and 6 are respectively a longitudinal section and a cross-section of the jib.
Figure 6:
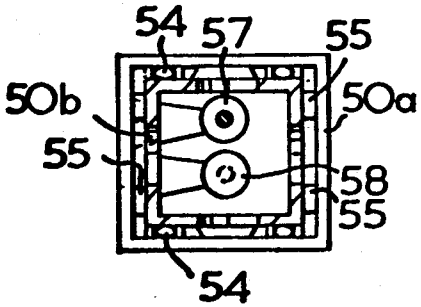
Figure 7:
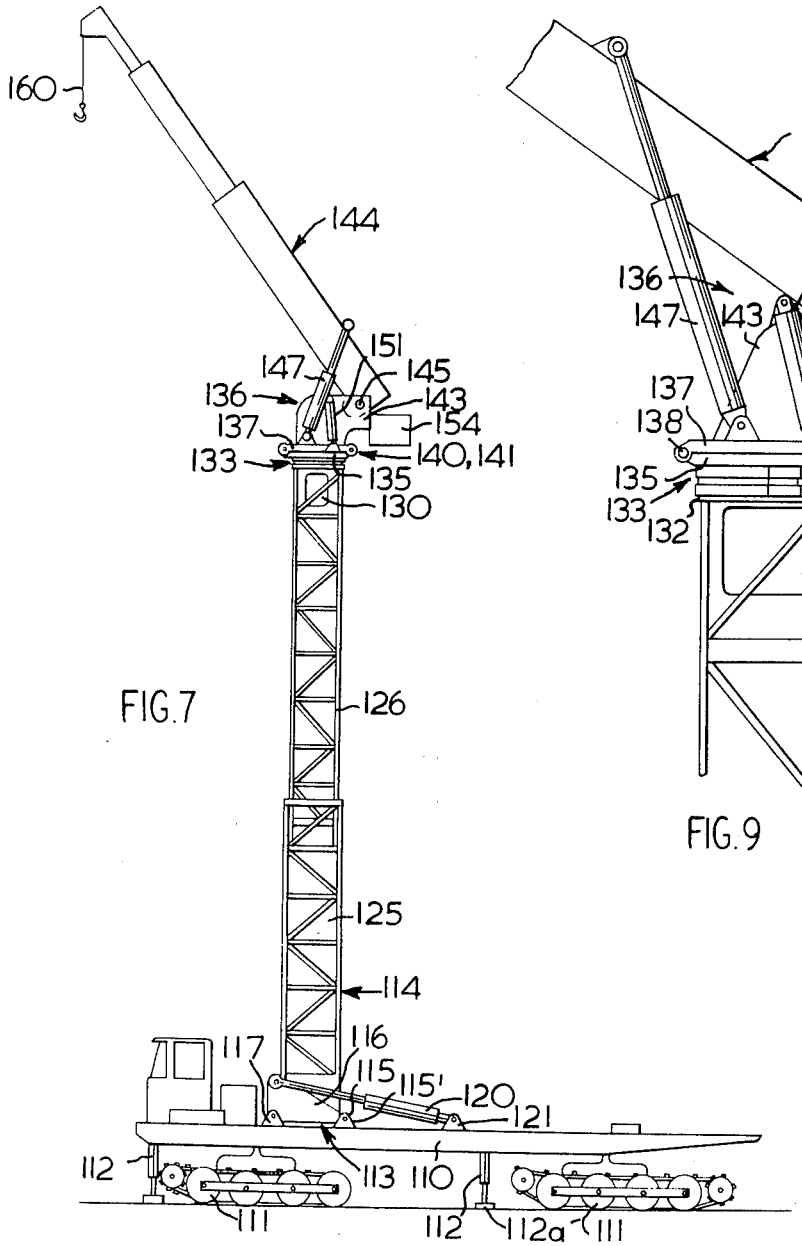
Figure 9:
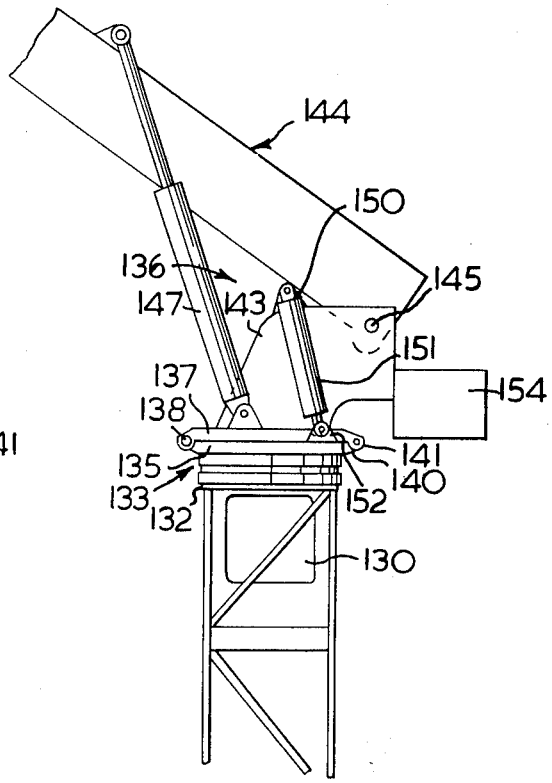
Figure 8:
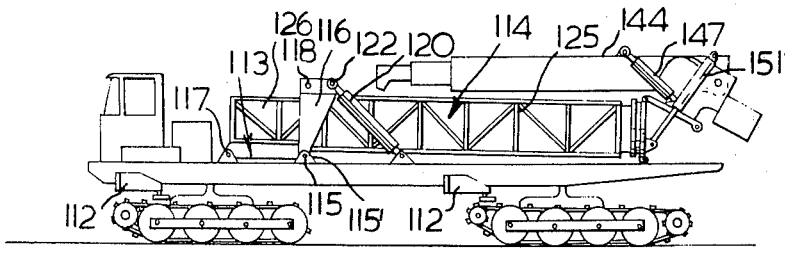
Figure 11:
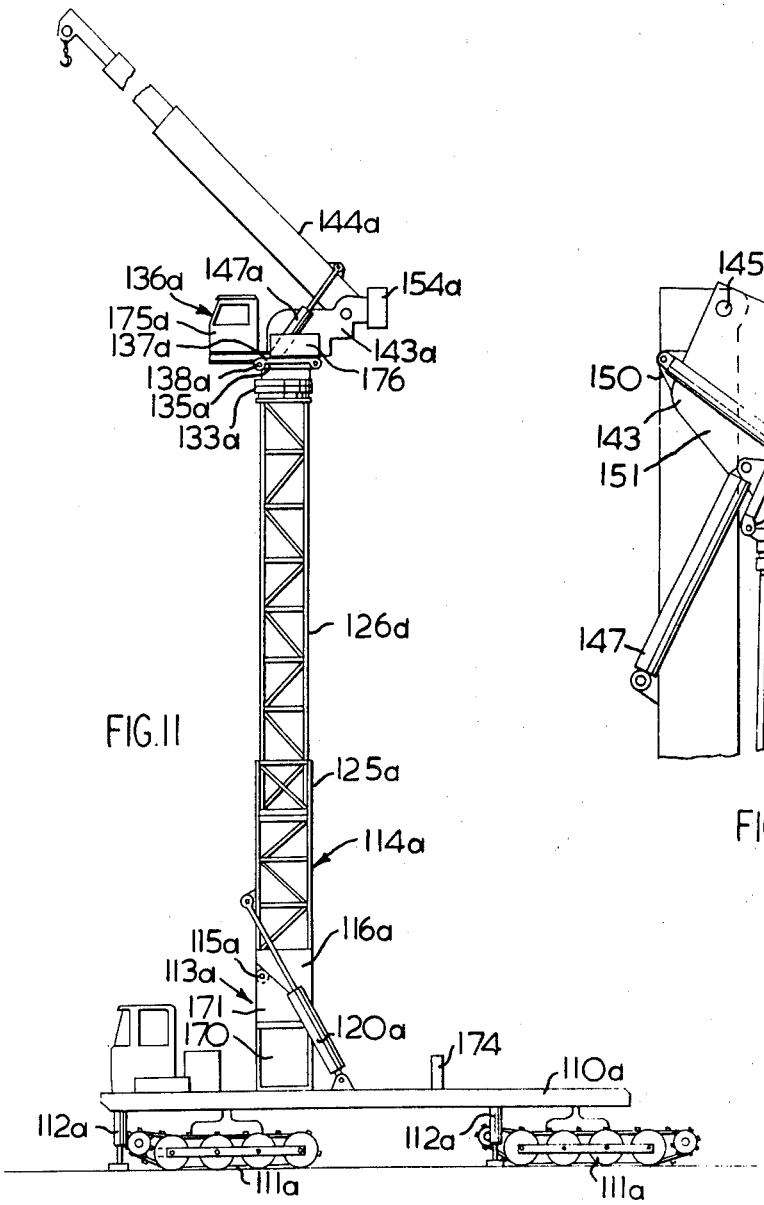
Figure 10:
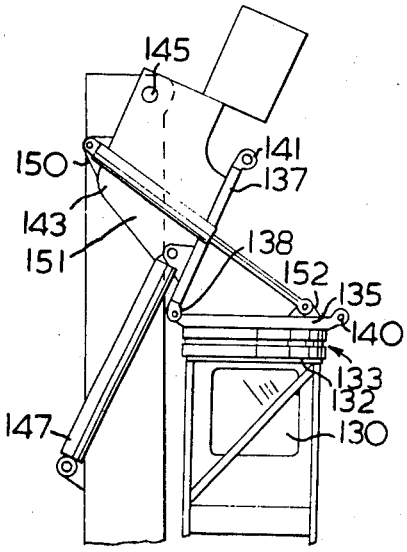
Figure 12:
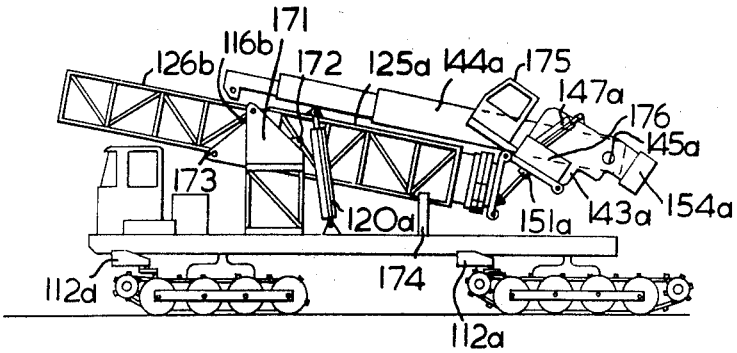
Figure 15:
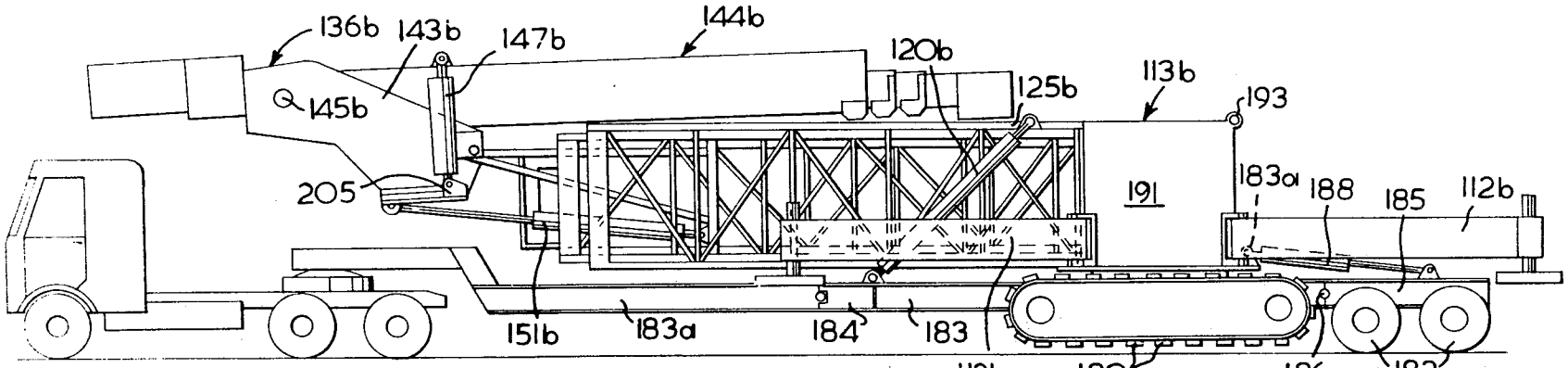
Figure 19:
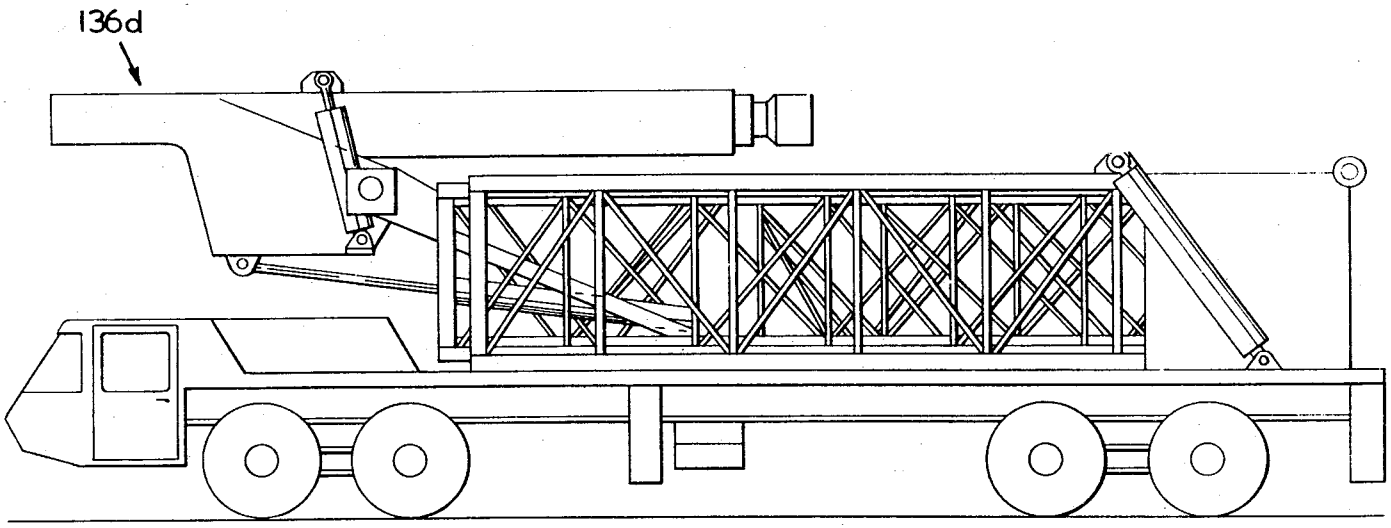
Figure 17:
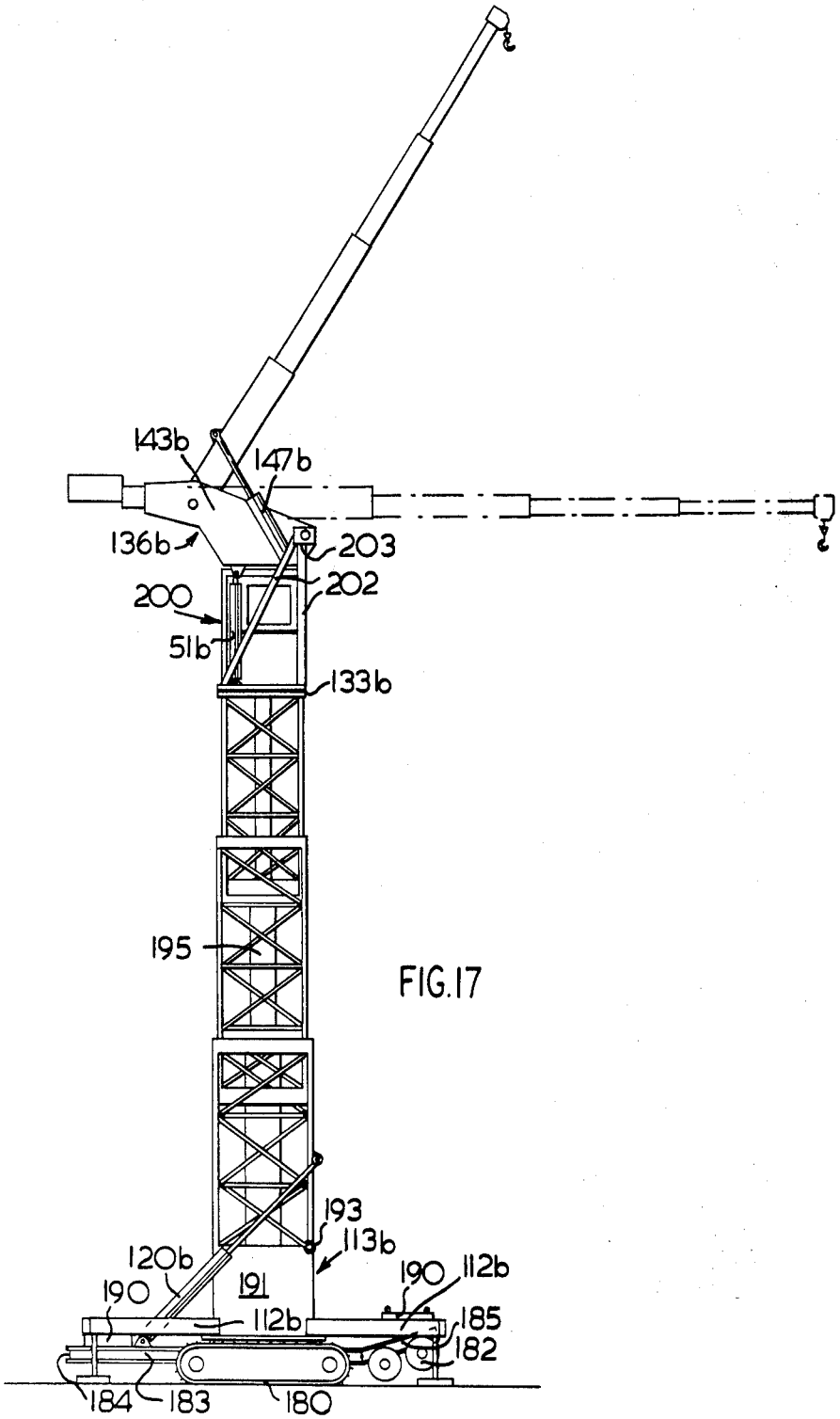
Figure 18:
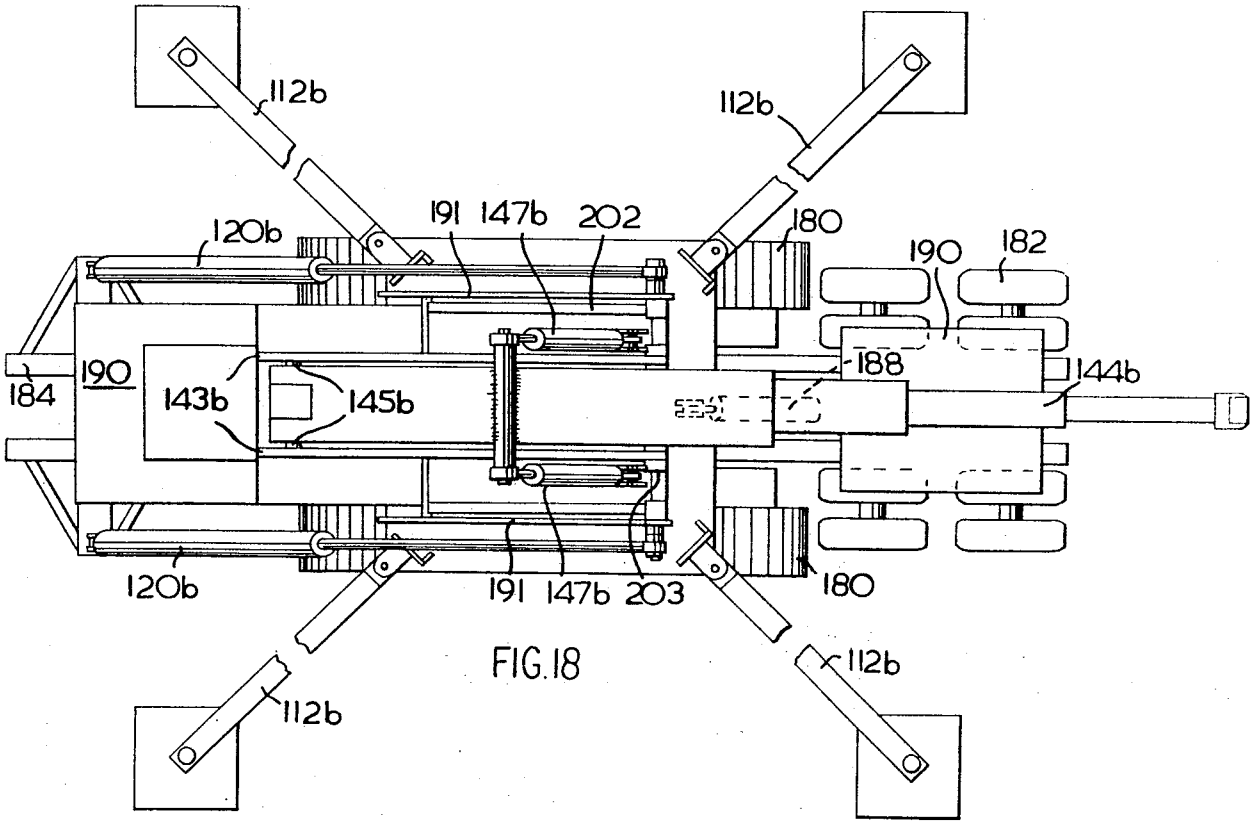

FIG. 7 shows a side elevation of a second embodiment of a crane in accordance with the invention, in the erected condition, FIG. 8 shows a similar view of the second embodiment of crane in the travelling condition, FIGS. 9 and 10 show detail side views of the jib support means of the crane of FIGS. 7 and 8, in the operative and folded conditions respectively, FIGS. 11 and 12 show side elevations of a third embodiment of a crane in the erected and travelling conditions, respectively, FIGS. 13 and 14 show detail side views of the jib support means of the crane of FIGS. 5 and 6 in the operative and folded conditions, respectively, FIG. 15 shows a side elevation of a fourth embodiment of crane, in travelling condition, FIG. 16 shows an end view of the crane of FIG. 15, in the travelling condition, FIG. 17 shows the main parts of the crane of FIG. 15, in the operative condition, FIG. 18 shows a top plan view of the crane of FIG. 15 in the operative condition, and FIG. 19 shows a side view of a fifth embodiment of crane in the folded condition.

Figure 1:
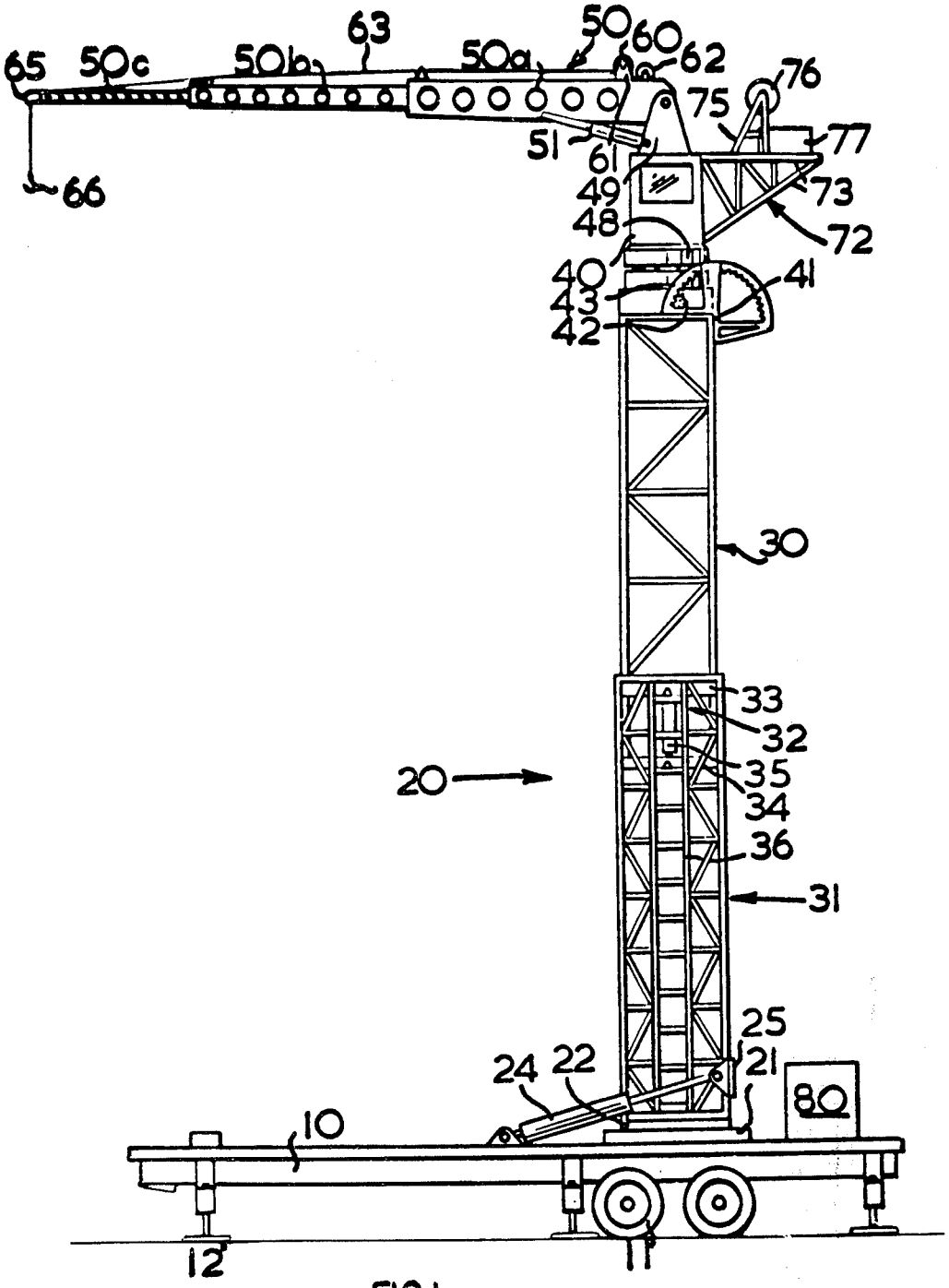
FIG. 1 shows a side elevation of a first embodiment of tower crane in erected condition, mounted on a semi-trailer.
Figure 2:
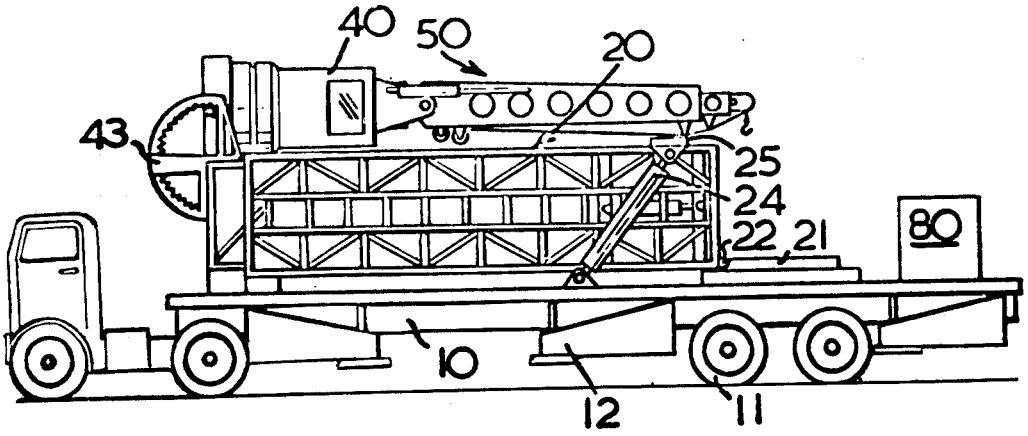
FIG. 2 is a side elevation of the same crane folded into its travelling condition, and with the trailer prepared for travelling.
Figure 4:
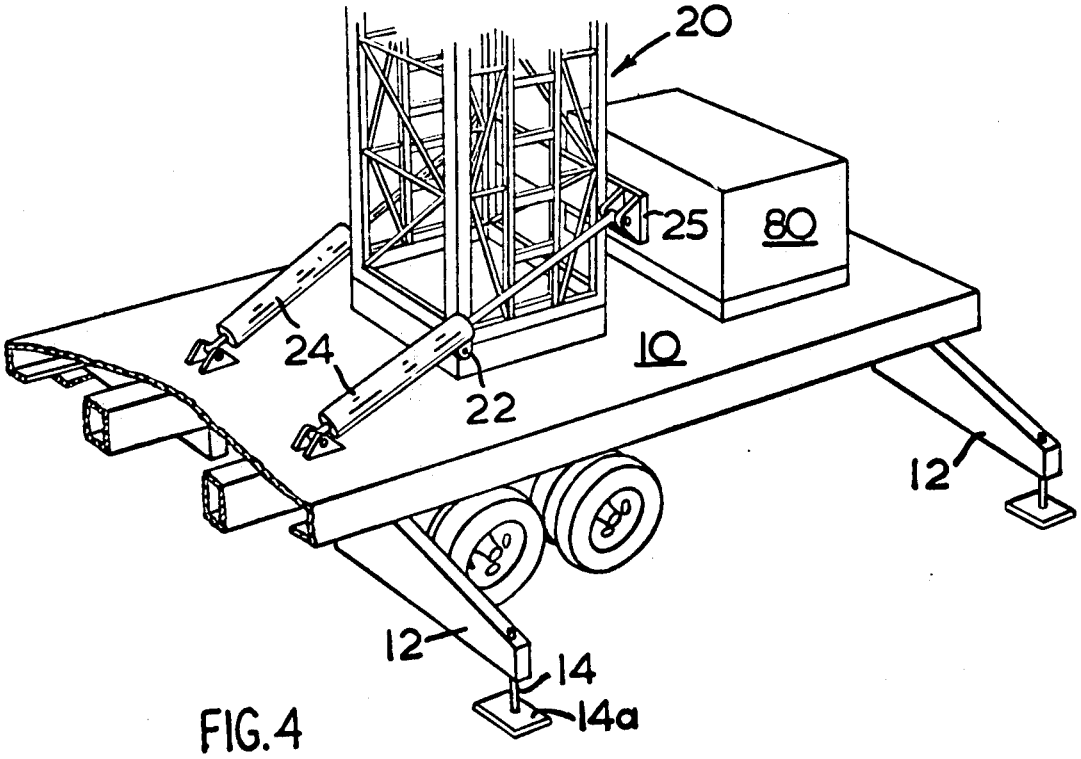
FIG. 4 is a perspective view of the base of the tower of the first embodiment.

Referring to FIGS. 1 to 6, the crane is shown supported on a mobile platform 10, which is constituted by the trailer portion of an articulated vehicle, the cab portion of which is shown in FIG. 2. The trailer 10 has road wheels 11, and three outriggers 12 on each side which engage the ground to support the trailer while the crane is in use. The outriggers are pivotally mounted beneath the trailer on vertical axes so that they can be swung outwardly from the sides of the trailer, as shown in FIG. 4. The outriggers have screw jacks 14 at their outer end with pads 14*a* for engaging the ground. When the jacks engage with the ground, the outriggers provide adequate stability for the crane which does not normally require any other stabilizing means such as guy-wires.

A tower 20 is mounted on trailer 10, the base of the tower resting on a reinforced pad 21 and being pivotally connected at the side thereof nearest the front of the trailer by hinge pins 22. The tower is tiltable between the erected, operative position shown in FIG. 1 to the horizontal travelling position on the trailer shown in FIG. 2, in which latter position the tower is wholly supported by the platform 10. Tilting movement of the tower is effected by two double acting hydraulic rams 24 which are connected at one end to fixed points on the trailer chassis and which pass one on each side of the tower and connect to a horizontal bar 25 firmly secured to the side of the tower facing the rear of the trailer. When the tower has been raised to its vertical position by rams 24, it is held in this position either by maintaining suitable pressure within the rams, or by fixing the base of the tower to pad 21 by known means such as latches, or bolts inserted through corresponding bolt holes in the pad and tower base.

The tower is a lattice type structure of form known for non-mobile tower cranes, having box beam corner members and tubular cross bracing members. Also, the tower is of known telescopic form, incorporating uppe (inner) and lower (outer) telescoping portions 30 and 31 respectively, and raisable by means of a known hydraulic climbing mechanism 32. This climbing mechanism is mounted in the upper telescoping portion, and includes two cross members 33 and 34, the upper member 33 being rigidly attached to the base of the upper tower portion, and being connected by hydraulic ram 35 to the lower cross member 34. Both cross members have at their ends automatic latching lugs which engage on two reinforced ladder members 36 on opposite sides of the outer or lower tower portion. With the lugs of member 34 engaging rungs of the ladder members 36, the ram 35 is extended to raise the member 33 and with it the upper tower portion, until the latches of member 33 engage on rungs of the ladder. The ram 35 is then retracted until the latches of member 34 engage on a higher rung, and the procedure is then repeated so raising the upper tower portion.

Figure 3:
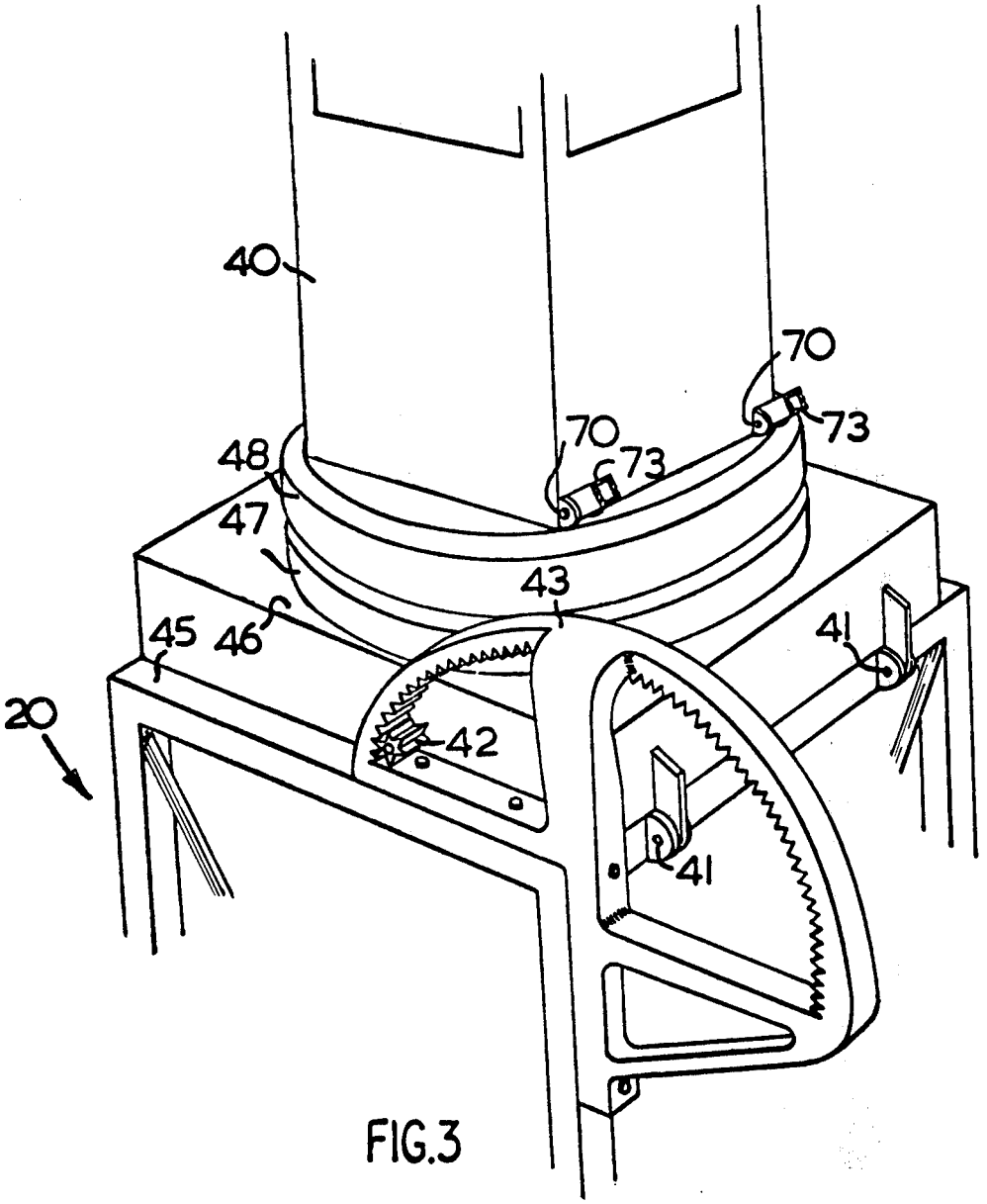
FIG. 3 is a perspective view of the top portion of the tower of the first embodiment showing the cab mounting arrangement.

As best seen in FIG. 3, the top of the tower is constituted by a reinforced plate 45, on which rests a box-like platform 46 carrying the lower portion 47 of a large diameter ball bearing. The upper portion of this bearing forms a turntable 48 to which is fixed the base of an operator's cab 40. The cab contains a hydraulic motor geared to a gear ring attached to the platform 46, by means of which the turntable and cab are rotated for slewing the jib.

The platform 46 is pivotally attached to the top of the tower 20 by means of hinge pins 41 passing through lugs attached to platform 46 and further lugs attached to the tower at the side thereof facing the rear of the trailer. Pivotal movement of the cab in the vertical plane is effected by a pinion 42 driven by a hydraulic motor within platform 46, which pinion engages with the internal teeth of a gear ring 43 attached to the top of the tower. The arrangement enables the platform 46 with the turntable and cab to be pivoted about hinge pins 41 through approximately 180° of movement, between an operating position in which the cab forms an extension of the tower, and a travelling position, shown in FIG. 2, in which the cab lies alongside the tower. Locking means are provided for securing the platform 46 in its operating position on the tower.

The top of cab 40 is constituted by a heavy plate member on which is mounted a bracket having two side plates 49. These side plates carry between them a horizontal pivot supporting a jib 50 and allowing for vertical pivoting (i.e. luffing) movement thereof. This luffing movement is effected by a hydraulic ram 51 connected between a pivot point on the jib near to the inner end thereof and to the base of bracket 49.

It will be noted that, since the jib structure including the cab 40, the bracket 49, and the jib 50, rotates about the tower axis on the turntable, in operation the tower is subject to bending stresses in various directions, as the jib rotates around the tower carrying a load. It is evident therefore that the combination of the tower and its base mounting, and the means used to hold the tower in the vertical position, must be designed to resist such bending stresses, and to provide a firm support for the jib structure. Accordingly, the tower itself is similar to those used in the previously described non-mobile cranes, rather than the towers used in conventional mobile cranes which cannot withstand substantial bending forces without being held by stays, and which rotate with the jib.

The jib 50, which is shown in detail in FIGS. 5 and 6, comprises three telescoping sections, 50*a*, 50*b*, and 50*c* respectively. These sections are of hollow box-type construction, the side plates of which are apertured for lightness. Each of the sections 50*a* and 50*b* has internal wear plates 55 acting as guides for the plates of the next section telescoping therein. In addition, support pads 56 are provided near the outer ends of the sections 50*a* and 50*b*, which provide strong support means for the ends of the next outer sections when these are in the extended position shown. These support pads 56 are of such thickness as to be clear of the adjacent surfaces of the respective top and bottom plates when the jib is being extended under no-load conditions and the sections are moving on rollers 54, but as soon as the jib is loaded to any substantial extent deflection occurs in the rollers to bring the top and bottom plates of the sections into contact with these support pads 56.

The jib sections are extendible and retractable by longitudinally extending hydraulic cylinders 57 and 58 within and attached to the sections 50*a* and 50*b*, the piston rod of each hydraulic cylinder being connected to the next outer section. Thus the piston rod of the cylinder 57 within section 50*a* controls section 50*b*, and the piston rod of the cylinder 58 within section 50*b* controls section 50*c*.

A cable winch 60 is mounted on bracket 61 on the top of the inner jib section 50*a*, and this winch is driven via gearing by motor 62. Cable 63 passes from the winch drum through guides along the top of the jib to a pulley 65 at the outer end of section 50*c*, and finally to a hook 66. The winch motor is controlled from within the cab to raise or lower the crane hook in accordance with known practice.

The cab 40 has attachment points 70 fixed to the four corners of the rear of the cab, for attachment of a counterweight support frame 72 shown in FIG. 1. This support frame has main members 73, the inner ends of which engage in attachment points 70, being held by removable pins. The upper horizontal frame members carry an A frame 75 supporting a pulley 76. The outer end of the support frame is formed with an aperture through which a counterweight 77 can be raised by a cable passing over pulley 76, and holding means such as slidable bars are provided to extend across this aperture and support the counterweight when in position as shown in FIG. 1.

The hydraulic supply for the tower raising rams 24, the tower climbing mechanism, and the jib movement, is provided for by a pump and drive motor contained in a power unit 80 mounted at the rear of the trailer. This power unit also has control gear in particular related to those functions not controlled from the cab, i.e. the raising and lowering of the tower, and the vertical pivoting movement of the cab 40 on the tower and the pivoting of the tower for folding this onto the platform.

When erected as shown in FIG. 1, the crane is operated from the cab 40 in accordance with normal practice for tower cranes. The jib performs all the usual motions of a luffing-type crane jib, with the additional telescoping motion controlled by the hydraulic means described.

When it is required to prepare the crane for movement to a different site, the counterweight is first lowered, with the cab swung around so that the counterweight can be positioned on a suitable part of the trailer, or on a separate vehicle. In this operation, the jib is first raised to near its vertical position, and the cable 63 is run out so that this may be sheaved under a pulley within bracket 49 (not shown) and over the pulley 76, hook 66 being then attached to the counterweight. Winch 60 is operated to raise the counterweight slightly to allow the removal of the holding means from under the counterweight, and then operated in reverse manner to lower the counterweight through the frame 72.

After the removal of the counterweight, the hydraulic climbing mechanism 32 is operated to cause the upper tower portion 30 to telescope within the lower portion 31 to reduce the tower to the minimum height. With the jib 50 raised to a position above the cab, the rams 24 are then operated to lower the tower structure onto the platform 10. The motor geared to pinion 42 is then operated to raise the cab and jib to a position just above centre, at which position the jib cable and hook 66 can be used for supporting the frame 72 while this is removed by extraction of the holding pins 70. With the frame 72 stowed separately, the cab 40 is then folded completely horizontally against the top section of the tower so that the crane assumes the travelling position shown in FIG. 2. With the motor driven cab section attached to the trailer as shown, the outriggers 12 are raised to allow the whole unit to move.

The movements described above are all interlocked in sequence to prevent the rams 24 being operated while the tower is extended or while jib 50 is not properly positioned, and also to prevent the cab from being folded until the tower has been lowered onto the platform.

Erection of the crane to the operating position is effected by reversing the above sequence of operations, interlocks also being provided to ensure that the operations are correctly sequenced.

As an alternative to using the jib cable 63 for lowering and raising the counterweight, a separate winch may be provided near the rear end of the jib, having a cable passing over pulley 76 and permanently attached to the counterweight, and this latter winch may be operated by the same motor 62 as operates winch 60.

It will be seen that the crane as described is readily mobile and versatile due to the extendibility of both the tower and the jib. The extendible jib allows loads to be manoeuvred close to the tower with the jib retracted and without the jib being canted up at a steep angle, so that swinging of the load at the end of the cable is minimized.

When it is required to raise very heavy loads, the jib may be supported by cables extending from an A frame erected on top of the cab. This A frame may be lifted into position by the jib itself.

In the first embodiment of crane described above, the tiltable unit comprising the turntable 48, the cab 40, and the jib support bracket 49, is tiltable through an angle of 180° by the gear ring 43. This is necessary since the jib pivot is spaced well above the pivotal connection between the tiltable unit and the tower, so that with tilting movement of much less than 180° the jib could not be aligned closely with the tower. This arrangement has the drawback that the tilting movement of 180° or thereabouts cannot be achieved with a single hydraulic cylinder. In accordance with my new embodiments of crane, this drawback is avoided by using jib folding means in the form of a tiltable unit carrying the jib pivot in which the pivotal mounting for the tiltable unit is relatively close to the jib pivot, so that the jib can lie close to the tower when the tiltable unit has been rotated to a folded position which is displaced about 90° from the operating position. The tiltable unit is thus rotatable through a folding angle of about 90° or less to align the jib with the tower, and this folding angle need be no more than the angle between the jib and the tower when the jib is in its lowermost normal operating position; accordingly movement of the tiltable unit can be achieved by a single hydraulic cylinder.

The new embodiments of cranes also have new folding arrangements, and other new features described below.

Referring now to FIGS. 7 to 11, these show a readily mobile tower crane supported on mobile platform means in the form of a truck having a unitary chassis 110 supported by front and rear pairs of steerable crawler tracks 111. The chassis is also provided with outriggers 112, for engaging the ground and supporting the chassis firmly when the crane is in use. The outriggers are pivotally mounted on the chassis for swinging movement about a vertical axis, and are provided with hydraulically operated ground engaging pads 112*a*.

Near to the front of the chassis, behind the driver's cab, there is provided a base mounting 113 for the tower 114 of the crane. The base mounting 113 includes a reinforced portion of chassis arranged to support the base of the tower when erected, and pivot means 115 connecting the base of the tower to the mounting. The pivot means 115 comprise hinge pins which pass through upstanding lugs 115' fixed to the chassis, and through holes in plate members 116 which are firmly fixed to each lateral side of the base of the tower. The base mounting also includes lugs 117, near to the driver's cab, which have bolt holes which become aligned with further bolt holes 118 in the plate member 116 when the tower is raised to its vertical operating position, and the tower may be fixed in this vertical position by inserting bolts through corresponding holes 118 and those in the lugs 117. The tower is tiltable between the horizontal travelling position of FIG. 8 and the vertical operating position of FIG. 7 by raising means comprising two double acting hydraulic rams 120, arranged one at each side of the tower. The rams are connected between lugs 121 on the chassis to the rear of the mounting 113, and further hinge pins 122 carried by an extension of the plates 116. The arrangement is such that extension of the rams 120 raises the tower to the vertical position by pivoting this about the pivot means 115.

The tower is of lattice type structure of a type generally known for non-mobile tower cranes which are normally fixed in position and which carry a turntable at their upper ends. The tower has box beam corner members and tubular bracing members. The tower is of telescopic form, incorporating a lower, outer section 125, and an inner upper section 126, and these sections are slidably arranged in a manner known in the art. Sliding movement is effected by a rack and pinion arrangement, including a hydraulically operated motor attached to the lower section 125 near to its upper end, and driving a pinion which cooperates with a rack extending along the upper section 126.

It will be noted that the upper section 126 is somewhat longer than lower section 125. During folding of the crane, the upper section 126 is firstly retracted within the lower section while the tower is still vertical, until the base of the upper section is adjacent that of the lower section. After the tower has been lowered to the horizontal position by rams 120, the upper section 126 can be slid further within the section 125 to the position shown in FIG. 8, in which the upper ends of the two sections are adjacent and the lower end of section 126 projects beyond that of section 125, thus projecting over the area of the base mounting 113 and thereby utilizing space on the vehicle which would otherwise be wasted.

The top portion of the tower section 126, as shown in detail in FIGS. 9 and 10 incorporates a cab 130, and the jib structure including the jib support means with which the present invention is primarily concerned are mounted on top of this cab. The jib support means includes a plate 132 forming the roof of the cab and which carries the lower portion of a large diameter ball bearing 133. The upper portion of this bearing forms a turntable for the rotatable part of the jib support means, and the cab includes a hydraulically operated motor for rotating the turntable and thus slewing the jib. The turntable carries a fixed support plate 135, and the remainder of the jib support means is constituted by a tiltable unit 136 which is carried by a tiltable support plate 137 pivotally mounted on the support plate 135. The pivotal mounting for the tiltable unit 136 is constituted by hinge means 138 which connect brackets on one side of the fixed plate 135 (hereinafter termed the front side) with similar brackets on the front side of the tiltable support plate 137. Similar brackets 140 and 141 are provided on the rear side of the plates 135 and 137, and these latter brackets have holes which are aligned when the tiltable unit is in the operating position as shown in FIG. 7, so that the tiltable unit can be locked in this operating position by insertion of suitable bolts through the holes in these brackets.

The tiltable support plate 137 carries a jib mounting bracket 143 including heavy side plates defining a recess for the inner end of a jib 144, and carrying bearing means for a jib pivot 145 on which the jib is mounted. The jib projects outwardly over the front side of the jib support means, and the jib pivot 145 is such as to allow luffing movement of the jib, and is positioned to the rear of the tower axis, being behind the plane of the rear face of the tower. A pair of jib luffing cylinders 147 are provided each having one end connected to a bracket on the top of the jib and the other end connected to the jib mounting bracket 143 at a point near to the pivot mounting 138 of the tiltable unit. The jib luffing cylinders 147 are dimensioned and arranged so that, with the tiltable unit in the operating position, the cylinders 147 can cause luffing movement of the jib between a raised position about 30° below the horizontal.

The jib 144 itself is a three section telescoping jib, which includes hydraulic cylinder means operable to cause telescoping movement of the sections. The jib may be of the type described in my aforesaid Canadian patent, or may be other similar types of jib known in the hydraulic crane art. It will be noted that the proportions of the tower and the jib are such that the majority of the height of the crane hook is provided for by the tower, the jib when extended being shorter than the tower when extended.

The jib mounting bracket also carries a pivot mounting 150 for the outer end of a second hydraulic cylinder 151, the piston rod end of which is connected to a lug 152 on the rear of the side of the fixed plate 135. This second hydraulic cylinder 151 is dimensioned and arranged so that, with the bolt means connecting the brackets 140 and 141 removed, the cylinder 151 can be used to tilt the tiltable unit 136 about pivot mounting 138 from the operative position shown in FIG. 9 to the folded position shown in FIG. 10. This movement involves a tilting of the unit 136 through a folding angle of about 60°, or at least equivalent to the substantial angle between the tower axis and the jib when the unit 136 is in its operating position and when the cylinder is retracted to bring the jib 144 to its lowered position. Accordingly, with the turntable so positioned that the jib is at the front side of the tower in relation to the vehicle (i.e., the top side of the tower when folded), the jib may be folded alongside the tower by firstly operating the hydraulic cylinder 147 to bring the jib down to its lowermost operating position, and then operating the second hydraulic cylinder 151 to tilt the unit 136 through about 60° and to bring the jib into alignment with the tower, as shown in FIG. 10.

It will be seen that the relationship between the jib pivot 145 and the jib itself, as well as the positions of the pivot mounting 138 and the amount of tilting movement given by cylinder 151, are such that in the folded position the jib lies closely alongside the front of the tower, so that in the folded position of FIG. 8 the height of the crane is at a minimum.

Also, it may be noted that in the operating position, the jib pivot 145, and therefore the main weight of the jib mounting bracket 143, is behind the tower axis, so that the bracket 143 itself forms a partial counterweight for the jib. In addition, however, a further heavy counterweight 154 is provided, fixed to the rear end of the bracket 143. The provision of fixed counterweight means significantly reduces the erection time for the crane as compared to that required for the erection of the crane shown in FIGS. 1 to 6, which showed a removable counterweight and counterweight support frame which had to be fixed in place during the erection of the crane.

The tilting of the unit 136 from the operative position to the folded position moves the jib pivot 145 forwards from the position behind the tower axis to a position in front of the tower axis. The fact that the jib pivot moves in this way simplifies construction of the jib, since it means that in order for the jib to be foldable alongside the tower it is not necessary for the jib pivot to be offset to a large extent from the jib axis.

The jib 144 has a cable winch recessed therein at its inner end near to the jib pivot, which is connected to the crane hook cable 160. This is in accordance with usual hydraulic crane construction.

Erection of the crane as described is very simple. Firstly, when a suitable site has been chosen, and beginning with the crane in the travelling position of FIG. 8, the outriggers 112 are positioned to give firm support for the chassis 110. Next, the hydraulic motor connected to the tower telescoping rack and pinion mechanism is operated to move the upper tower section 126 a short distance towards the rear of the vehicle, until the base of the upper section passes through the base of the lower section 125. Next, the rams 120 are operated to raise the tower to the vertical operating position, and the tower is secured in this position by bolts passed through lugs 117 and holes 118. The ram 151 is then operated to tilt the unit 136 to the operating position of FIG. 7, bringing the jib to its lowermost normal operating position. The hydraulically powered rack and pin mechanism is again operated to raise the tower to the required height, and the tower sections are then locked together by means known in the art. The crane operator then climbs a ladder provided (not shown), and after entering the cab 130 secures the tiltable unit 136 by inserting bolts through holes in the brackets 140 and 141. The crane is then ready for operation. The estimated erection time for this crane is less than 10 minutes.

A crane having a tilting top similar to that of FIGS. 7 to 10 may also have a cab which, instead of being fixed in the tower, is rotatable with the jib. One rotatable cab arrangement is shown in the embodiment of crane shown in FIGS. 11 to 14, which also differs from the crane just described in other significant respects, in particulaar the manner in which the tower is folded to allow use of a minimum length of vehicle in relation to tower height.

The crane shown in FIGS. 11 to 14 has many parts similar to corresponding parts of the crane described with reference to FIGS. 7 to 10, and these parts are shown by the same reference numerals but with the suffix *a*. These include mobile platform means in the form of a vehicle having a unitary chassis 110*a* on which the crane structure is mounted. The chassis 110*a* carries, behind the vehicle cab, a mounting 110*a* raised above the vehicle chassis. This mounting comprises a short tower section 170 similar in height to the vehicle cab and which carries a bracket consisting of two side plates 171 of triangular form the top ends of which carry bearings for pivot means 115*a*. The lower section 125*a* of the tower has two side plates 116*a* attached to the lateral sides of its base, and these plates 116*a* have lugs 116*b* pivotally connected by pivot means 115*a* to the bracket plates 171 thus allowing tilting movement of the tower about pivot means 115*a*, the plates 171 being spaced apart sufficiently to allow the lower tower section to move therebetween. The plates 171 also have lugs 172 which have bolt holes which are aligned with bolt holes 173 in the plates 116a when the tower is erected as shown in FIG. 11, so that the tower can be held in the erected position by inserting bolts through these bolt holes. Rams 120*a* are provided for tiltably moving the tower between the slightly sloping travelling position of FIG. 12 and the vertical erected position of FIG. 11. A rest 174 is provided to the rear of mounting 113*a* for supporting the rear of the tower when in the travelling position. It will be noted that the use of the raised mounting 113*a* serves two purposes; firstly it increases the tower operating height by an amount equivalent to the height of the mounting up to the pivot means 115*a*, and secondly it allows the use of a special sloping arrangement (to be described) in which part of the tower is above the cab.

The tower comprises two telescoping sections 125*a* and 126*a*, generally similar to the sections of the crane described above and telescopingly movable by similar means, but with the upper section 126*a* being much longer than the lower section 125*a*, in fact being nearly twice the length of this lower section. The difference in length between the upper and lower sections is greater than the distance separating the mounting 113*a* and the rear of the vehicle cab. When the tower is being folded, it is first telescoped downwards while erect, until the base of upper section 126*a* is adjacent that of lower section 125*a*, and the tower is then tilted down to a position in which the tops of the tower sections (i.e. the upper ends in the erected position) are below the bases of the sections. The telescoping of the tower is then resumed until the base of the upper tower section 126*a* comes above the cab of the vehicle, as shown in FIG. 12, and in which the tops of the tower sections are adjacent each other.

It will be seen that this modified arrangement allows utilization of the space above the vehicle cab for accommodating the folded tower, and therefore allows the folded crane and vehicle combination (for a given tower height) to be shorter, although higher, than with the configuration of FIG. 8.

The top of the tower carries the lower part of a ball bearing 133*a*, the upper part of which bearing forms a turntable supporting a fixed support plate 135*a*. Plate 135*a* carries a tiltable support plate 137*a* hingedly attached thereto at 138*a*, this support plate 137*a* carrying the tiltable unit 136*a*. Brackets 140*a* and 141*a* are provided on the respective support plates 135*a* and 137*a*, and these brackets have bolt holes which are in alignment with each other in the operating position of the unit 136*a*, as shown in FIGS. 11 and 13, so that the tiltable unit can be fixed in the operating position by inserting bolts through these bolt holes.

The tiltable unit 136*a* includes a jib mounting bracket 143*a* generally similar to that of FIGS. 7 to 10, except in that this extends further rearwardly, so that the counterweight 154*a* is displaced further from the tower axis. The arrangement of the jib luffing cylinders 147*a* and the cylinder 151 which tilts the unit 136*a* are also arranged in similar manner to those of FIGS. 7 to 10. In this embodiment, however, both the cylinders 147*a* and 151*a* are arranged to give about the same degree of pivotal movement to their respective parts, i.e. the angle through which the cylinders 147*a* are capable of moving the jib 144*a* between its uppermost and lowermost positions is roughly equivalent to the angle through which the tiltable unit 136*a* is tilted between its operating and folded positions, both these angles being around 85°.

The main difference between the modified arrangement of FIGS. 11 to 14 however, and FIGS. 7 to 10, lies in the arrangement of the cab, this cab 175 being mounted on a forwards extension of the plate 137*a* and to one side of the path of movement of the jib 144*a*. The arrangement is such that in the lowered position of the jib, for example as in FIG. 12, the jib lies alongside the cab. Clearly, in this arrangement, the cab is not a structural part required to carry any bending stress.

Another feature of the embodiment of FIGS. 11 to 14 is the provision of an engine 176, which is also mounted on an extension of the plate 137a, this extension being on the opposite side to the jib from the cab 175, and central in the fore and aft direction. This engine is connected to a hydraulic pump, which is capable of supplying power for the hydraulic movements of the jib.

Operation of the crane as shown in FIGS. 11 to 14 is generally identical to that of FIGS. 7 to 10, and therefore will not be further described. It may be noted, however, in this connection that in the folded position of the tiltable unit the jib pivot is in a position well forward of the top side of the folded tower, so that in fact the jib pivot can be almost aligned with the jib axis.

The jib support means as shown in either of the embodiments described above may be modified by the provision of a movable counterweight, for example slidable on rail means on a frame extending behind the jib mounting bracket, hydraulic cylinder means being provided for moving the counterweight to alter its distance from the tower axis. This arrangement has two advantages: firstly the position of the counterweight may be adjusted either automatically or manually to give the minimum bending moment on the tower and turntable at all times, and secondly the counterweight may be retracted towards the tower axis for folding the crane, so that the folded crane occupies a minimum of space.

In the embodiments described the jib alignment means comprises a tiltable unit, which is a convenient arrangement due to its simplicity, and to the manner in which is allows the jib pivot to be moved from a rearwards position (where the jib mounting bracket partially counterbalances the jib) to a forwards position (in which the alignment of the jib with the tower is facilitated). However, other forms of jib folding means may be contemplated, which do not require any movement of the jib pivot. For example, the end of the jib luffing cylinder connected to the jib could be made movable along the jib, or the other end of the jib luffing cylinder could be made movable along the tower, in such manner as to fold the jib alongside the tower. Alternatively, the end of the jib luffing cylinder remote from the jib, instead of being fixed in relation to the jib mounting bracket, could be mounted on a swinging member, this member being enabled to be swung by second hydraulic cylinder means to a position in which the jib is brought alongside the tower.

FIGS. 15 to 18 show a semi-trailer mounted crane having several features not shown in the cranes described above.

The semi-trailer carrier shown in FIGS. 15 to 18 is provided with both crawler tracks 180 and rear road wheels 182 mounted on tandem axles. The crawler tracks 180 are mounted one at each side of the rear of a main chassis part 183, and the road wheels 182 are mounted on a rear chassis portion 185 which is connected to chassis part 183 by a pivot 186 which allows pivotal movement of portion 185 in the vertical plane. This pivotal movement is effected by a double acting hydraulic cylinder 188 connected between a lug 183*a* on the chassis part 183 and a lug 185*a* on the portion 185. The cylinder 188 is capable of moving the portion 185 from a raised position (shown in FIG. 15) in which road wheels 182 are raised clear of the surface engaged by tracks 180, to a lowered position (shown in FIG. 17) in which the road wheels 182 contact the ground, the movement of portion 185 to this lowered position causing the tracks 180 to be raised off the ground. Thus it will be seen that operation of cylinder 188 causes movement of the road wheels 182 between positions which are selectively above and below the plane of the lower surface of the crawler tracks.

The chassis part 183 on which tracks 180 are mounted is connected to detachable front portion 183*a* by interengaging connecting means in the form of a releasable joint 184, at the end of part 183 remote from road wheels 182, this is not however an articulated joint. It will be apparent that the separable front chassis part 183*a*, in the travelling condition of the crane (FIG. 15), extends under a portion of the length of the tower.

The chassis part 183 is also provided with outriggers which are set when the crane is operating.

The chassis part 183 forward of the tower mounting, and the pivotal portion 185, are each provided with reinforced areas for the reception of counterweights 190 shown in FIG. 17, which stabilize the crane and increase its operating capacity.

The tower shown in FIGS. 15 to 18 is tiltably mounted on a raised mounting 113b carried by chassis part 183 at the rear of the trailer, this mounting being centrally located with respect to crawler tracks 180. The mounting 113*b* is in the form of a bracket including two side plates 191 spaced apart to accommodate the lower section 125*b* of the tower, which tower section is pivotally attached to the plates 191 by a raised pivot 193 which pivot is at the rear upper corner of the bracket 113*b*, i.e., at the side remote from the side on which the main part of the tower lies in its travelling position. Accordingly, the tower height when raised includes the height of the bracket 113*b* up to pivot 193, and in the folded condition the base of the tower rests within the bracket 90 so that this space is not wasted.

The tower comprises three telescoping sections, each with hollow box beam corner members set diagonally across the corners of the sections, as shown in FIG. 16. The tower sections may be telescopically moved by a single multi-section telescoping hydraulic ram having a stroke equivalent to the total required movement of the top section.

The top of the crane of FIGS. 15 to 18 includes a rotatable cab 200, mounted on a turntable 133*b*. The cab has a structure similar to that of the tower. The cab has bracing struts 202 associated therewith and carrying bearing means 203 adjacent the top of cab 200 on which the tiltable unit 136*b* is pivotally mounted. A pair of hydraulic cylinders 151*b* is provided for tilting the unit 136*b*, these cylinders extending substantially the length of the cab and being mounted at their lower ends on the turntable. As seen in FIG. 15, the cylinder 151*b* is capable of tilting the unit 136*b* through a folding angle of approximately 90°, for folding the crane. A pair of jib luffing cylinders 147*b* are connected between brackets 205 attached to the base of tiltable unit 136*b*, and a bracket on the top of the jib 144*b*, the jib being pivoted to tiltable unit 136*b* at jib pivot 145*b* (FIG. 18) above the top of the cab. The nature of the jib mounting, the counterweight, and the cable winch, are all generally as described in detail with reference to the embodiment of FIGS. 7 to 10.

The operation of the crane is also similar to that of FIGS. 7 to 10, but includes operation of the crane on its crawler tracks 180. After arrival on site in the condition of FIG. 15, the cylinder 188 is operated to raise wheels 182, so that the trailer rests on tracks 180. The crane is then erected in manner similar to that described with reference to the embodiment of FIGS. 7 to 10. After erection, the crane is used to support the chassis portion 183*a* while this is detached from portion 183 at joint 184, and the portion 183*a* is then removed by the tractor vehicle. The crane is then in the condition shown in FIG. 17, and can be moved on its crawler tracks around a building site. Before such movement, the outriggers 207 are of course raised, and the tower is preferably telescoped down to its minimum height to improve the stability. The removal of chassis portion 183*a* improves the mobility of the crane in this condition. For operation of the crane in a selected position, the outriggers 207 are set, as shown in FIG. 18.

For preparing the crane for travelling, the trailer chassis portion 183*a* can be re-positioned and attached at joint 184 while being supported by the crane hook.

FIG. 15 illustrates the manner in which the tilting of unit 136*b* causes this unit to be effectively raised from the carrier when the crane is folded, as compared to the position which would be occupied by a non-tiltable unit, thus avoiding carrier parts such as the trailer "goose neck" and the cab. In fact, with the arrangement of FIGS. 10 to 12, in which the tower mounting is at the rear of the trailer, the folded tiltable unit 136a fits conveniently above the carrier cab. This is achieved by arranging that bearing means 203 are approximately aligned with the side of the turntable 133*b* which is uppermost when the crane is in the travelling condition. Since the main part of the jib is disposed above these bearing means, this allows part of the jib to project over the upper side of the tower and a further part to be raised above an upwardly projecting part of the carrier such as the goose-neck and/or the carrier cab which part lies beyond the top of the lowered tower.

FIG. 19 shows a crane similar to that of FIGS. 15 to 18, but mounted on a standard truck without crawler tracks. Again, it will be seen that the tiltable unit 136*d* fits conveniently over the truck cab.

I claim:

1. A mobile tower crane, comprising mobile platform means carrying in combination a base mounting for a tower, a tower pivotally connected to said mounting for tilting movement between a vertical operating position and a substantially horizontal travelling position in which travelling position the tower is supported by said mobile platform means, and raising means interconnecting the platform means and the tower for moving the tower between said positions, said combination being such that the tower when raised provides a firm support suitable for supporting a jib structure which is rotatable relative to the tower about the tower axis and which thereby in operation causes bending moments to be applied to said tower in various directions; and a jib structure carried by said tower which structure includes jib and jib support means, said jib support means including a turntable mounted at the top of the tower and means for rotating said turntable to cause slewing of the jib support means about the tower axis, a jib pivot mounting said jib on said jib support means to allow luffing movement thereof, and first hydraulic cylinder means connected between said jib support means and said jib for causing said luffing movement; wherein there is provided a tiltable unit carrying the jib pivot which unit is pivotally connected to the tower, and second hydraulic cylinder means connected to said tiltable unit for causing pivoting thereof between an operating position and a folded position, in which operating position, with the tower vertical, the said first hydraulic cylinder means is capable of luffing the jib between a raised position in which it forms an extension of the tower and a lowered position in which the jib forms a substantial angle of between about 60° and 90° with the tower axis, and in which the said second hydraulic cylinder means is capable of tilting said tiltable unit through an angle equivalent to said substantial angle, whereby the jib may be folded alongside the tower by operating said first cylinder means to lower the jib, and subsequently operating said second cylinder means to tilt the tiltable unit through said substantial angle, and wherein the relationship between the pivotal connection connecting the tiltable unit to the tower and the jib pivot is such that the jib lies close to the tower when the tiltable unit is in its folded condition.

2. A mobile tower crane according to claim 1, wherein a cab is provided at the top of the tower, and wherein said tiltable unit is mounted on top of said cab.

3. A mobile tower crane according to claim 2, wherein said cab is mounted on said turntable, and wherein said second hydraulic cylinder means extends substantially the length of said cab between a mounting near to the cab base and a connection with said tiltable unit.

* * * * *